US010743632B2

(12) United States Patent
Meersschaert

(10) Patent No.: US 10,743,632 B2
(45) Date of Patent: Aug. 18, 2020

(54) EXTENDABLE TOW HANDLE FOR A LUGGAGE ARTICLE

(71) Applicant: Samsonite IP Holdings S.a.r.l., Luxembourg (LU)

(72) Inventor: Reinhard Meersschaert, Merelbeke (BE)

(73) Assignee: Samsonite IP Holdings S.a r.l., Luxembourg (LU)

( * ) Notice: Subject to any disclaimer, the term of this patent is extended or adjusted under 35 U.S.C. 154(b) by 64 days.

(21) Appl. No.: 15/805,192

(22) Filed: Nov. 7, 2017

(65) Prior Publication Data

US 2018/0125192 A1 May 10, 2018

(30) Foreign Application Priority Data

Nov. 7, 2016 (EP) ..... 16197507

(51) Int. Cl.
*A45C 5/14* (2006.01)
*A45C 13/26* (2006.01)

(52) U.S. Cl.
CPC ..... *A45C 13/262* (2013.01); *A45C 5/14* (2013.01); *A45C 2013/265* (2013.01); *A45C 2013/267* (2013.01)

(58) Field of Classification Search
CPC ..... A45C 13/262; A45C 2013/267; A45C 2013/265
USPC ..... 190/39, 115; 16/405, 113.1
See application file for complete search history.

(56) References Cited

U.S. PATENT DOCUMENTS

| | | | | |
|---|---|---|---|---|
| 2,949,692 | A | 8/1960 | Kuhn | |
| 3,515,418 | A * | 6/1970 | Nielsen, Jr. ..... | A61B 5/021 403/109.5 |
| 4,076,437 | A | 2/1978 | Mazzolla | |
| 4,329,076 | A | 3/1982 | Coreth | |
| 4,653,142 | A | 3/1987 | Upton | |
| 4,824,302 | A | 4/1989 | Schulthesis | |
| 4,995,487 | A | 2/1991 | Plath et al. | |
| 5,011,319 | A | 4/1991 | Levi | |
| 5,048,998 | A | 9/1991 | Viets | |

(Continued)

FOREIGN PATENT DOCUMENTS

| | | | |
|---|---|---|---|
| DE | 202013006729 | U1 | 11/2013 |
| EP | 0006258 | A1 | 1/1980 |

(Continued)

OTHER PUBLICATIONS

Extended European Search Report of European Patent Application No. 16197507.3 dated May 17, 2017, 8 pages.

*Primary Examiner* — Sue A Weaver
(74) *Attorney, Agent, or Firm* — Dorsey & Whitney LLP

(57) ABSTRACT

An extendable tow handle for a luggage article is provided. The tow handle may include at least one tube structure each including first and second tubes, a rotational mechanism, and a hand grip coupled to one of the first and second tubes for gripping the tow handle by a user. The first tube may be slidably received within the second tube and selectively rotatable thereto. The rotational mechanism may be operable to rotate the first tube relative to the second tube. Rotation of the first tube relative to the second tube may cause at least a portion of the first tube to couple with a portion of the second tube to selectively frictionally lock axial movement of the first tube relative to the second tube.

16 Claims, 9 Drawing Sheets

(56) References Cited

U.S. PATENT DOCUMENTS

| | | | | | |
|---|---|---|---|---|---|
| 5,353,900 | A * | 10/1994 | Stilley | A45C 3/004 190/115 |
| 5,407,295 | A | 4/1995 | Kuhl | |
| 5,417,511 | A | 5/1995 | Warden | |
| 5,469,945 | A * | 11/1995 | Jserng | A45C 13/262 16/113.1 |
| 5,549,407 | A | 8/1996 | Levi et al. | |
| 5,553,350 | A * | 9/1996 | Chang | A45C 13/262 16/113.1 |
| 5,590,891 | A * | 1/1997 | Kazmark, Jr. | A45C 13/262 280/37 |
| 5,622,446 | A | 4/1997 | Hibberd | |
| 5,692,856 | A | 12/1997 | Newman et al. | |
| 5,970,579 | A * | 10/1999 | Lu | A45C 13/262 16/405 |
| 6,761,501 | B1 | 7/2004 | Nakatani | |
| 7,407,337 | B2 | 8/2008 | Tella et al. | |
| 7,670,072 | B2 | 3/2010 | Tella | |
| 7,694,387 | B1 * | 4/2010 | Huang | B25G 1/04 16/113.1 |
| 8,056,185 | B2 * | 11/2011 | Lai | A45C 13/262 16/113.1 |
| 2004/0211034 | A1 * | 10/2004 | Chen | F16B 7/1463 16/113.1 |
| 2009/0084648 | A1 * | 4/2009 | Tong | A45C 13/262 190/115 |

FOREIGN PATENT DOCUMENTS

| | | | | |
|---|---|---|---|---|
| GB | 2220163 | A * | 1/1990 | B25G 1/04 |
| KR | 10-1634662 | | 6/2016 | |

* cited by examiner

EXTENDABLE TOW HANDLE FOR A LUGGAGE ARTICLE

CROSS-REFERENCE TO RELATED APPLICATION

This application claims priority to European Patent Application No. 16197507.3, filed Nov. 7, 2016, entitled "Extendable Tow Handle For a Luggage Article", which is hereby incorporated by reference herein in its entirety for all purposes.

TECHNICAL FIELD

The present disclosure relates generally to wheeled luggage articles, and more specifically to an extendable tow handle for a luggage article.

BACKGROUND

Wheeled luggage articles often include an extendable tow handle to aid in maneuvering a luggage case across a support surface, such as the floor or ground. Typical extendable tow handles are telescopic and include an inner member or tube slidably received within an outer member or tube to adjust the height of a tow handle grip on the distal end of the handle relative the luggage case at preset heights for ease of use by a user. Unfortunately, the clearances and/or locking engagement between the inner and outer tube to allow easy sliding may be such that the tow handle moves or wobbles when manipulated by a user. Additionally, the locking engagement may be difficult to disengage. The preset heights of the tow handle may also be set at undesirable positions, especially for users of taller or shorter stature.

It is therefore desirable to provide an improved luggage article, and more specifically an improved extendable tow handle that addresses one or all of the above described problems and/or which more generally offers improvements or an alternative to existing arrangements. Because luggage is price and weight sensitive, creating smooth, efficient, lightweight, and cost effective wheels that perform better in both straight line tracking and also improved quietness is important.

Documents that may be related to the present disclosure in that they include various extendable tow handles include U.S. Pat. Nos. 7,670,072, 7,407,337, 6,761,501, 5,692,856, 5,549,407, 5,622,446, 5,417,511, 5,407,295, 5,011,319, 5,048,998, 4,824,302, 4,653,142, 4,329,076, EP0006258, U.S. Pat. Nos. 4,076,437, 3,515,418, and 2,949,692.

SUMMARY

The present disclosure provides an extendable tow handle for a luggage article as described below and defined in the accompanying claims. The present disclosure advantageously provides a tow handle that can be easily selectively locked at different lengths and so hand grip heights in a relatively simple and alternative manner and preferably without excessive (or with reduced) wobbling between the tow handle's sliding components once the tow handle is positioned in a locking arrangement. The tow handle includes an outer tube and an inner tube slidably received within the outer tube. As explained in detail below, the inner and outer tubes may be arranged such that rotation of one of the tubes (or parts thereof) relative to the other (or part thereof) selectively binds the tubes together to prevent or restrict relative axial movement of the tubes. Through such a configuration, the tow handle can be selectively frictionally locked at any desired height along the length of the tube relative to the luggage article.

Embodiments of the present disclosure may include a tow handle for a luggage article. The tow handle may include at least one tube structure each including first and second tubes, the first tube slidably received within the second tube and selectively rotatable thereto, a rotational mechanism operable to rotate the first tube relative to the second tube, and preferably a hand grip coupled to one of the first and second tubes for gripping the tow handle by a user. The tow handle and the first and second tubes may be arranged such that rotation of the first tube relative to the second tube causes at least a portion of the first tube to couple with, such as engaging (e.g., by directly engaging and/or by indirectly engaging), a portion of the second tube to selectively frictionally lock axial movement of the first tube relative to the second tube.

In some embodiments, the first and second tubes may couple along a substantial portion of the length of each tube structure. In other embodiments, the tubes may engage along a discrete portion of the length of each tube structure.

In some embodiments, the tow handle may include a collar rotatably coupled to one of the first and second tubes and selectively coupleable with the other of the first and second tubes to create the selective friction coupling between the first and second tubes. The tow handle may include means for axially locating the collar along a portion of either the first or second tube. The selective friction coupling between the first and second tubes may include a first friction interface between the collar and one of the first and second tubes, the first friction interface including a first coefficient of friction, and a second friction interface between the collar and the other of the first and second tubes, the second friction interface including a second coefficient of friction greater than the first coefficient of friction. The first friction interface may be between the collar and the first tube, and the second friction interface may be between the collar and the second tube.

In some embodiments, the means for axially locating the collar includes a stopper associated with a portion of the first or second tube, the stopper defining an annular recess therein for receiving at least a portion of the collar such that the collar slides correspondingly with the stopper. The stopper may be defined adjacent an end of either the first or second tube. The stopper may limit extension of the first tube relative to the second tube.

In some embodiments, the first tube or the stopper may include an outer surface of varying radius such that rotation of at least a portion of the first tube or the stopper relative to the collar increases the friction between the collar and an inner surface of the second tube. The inner surface of the second tube may include a varying radius corresponding to the outer surface of the collar. The collar may be biased to constrict away from the second tube. In some embodiments, rotation of at least a portion of the first tube or the stopper relative to the collar may expand the collar to engage the collar to the inner surface of the second tube.

In some embodiments, the collar may include an inner surface arranged to engage an outer surface of either the first tube or the stopper, and an outer surface arranged to engage an inner surface of the second tube. The inner surface of the collar may be parallel to the outer surface of the stopper or the first tube. The outer surface of the collar may be parallel to the inner surface of the second tube. The outer surface of the stopper or the first tube may be parallel to the inner surface of the second tube.

In some embodiments, the rotational mechanism may move the at least one tube structure between a sliding arrangement wherein the first and second tubes of the at least one tube structure are permitted to slide relative each other, and a locking arrangement wherein sliding movement of the first and second tubes relative each other is limited. Rotation of at least a portion of the hand grip preferably causes the rotational mechanism to position the at least one tube structure in either the sliding or locking arrangement. The hand grip, or at least a portion of the hand grip, may be at and rotate about an axis oriented at an angle to the at least one tube structure.

In some embodiments, the tow handle may include a biasing assembly operable to bias the at least one tube structure to frictionally lock axial movement of the first tube relative to the second tube, such as to the locking arrangement. The biasing assembly may include a torsion spring biasing rotation of the at least a portion of the hand grip to frictionally lock the at least one tube structure.

In some embodiments, the first tube may include an outer profile and the second tube may include an inner profile, at least a portion of the outer profile of the first tube selectively engaging at least a portion of the inner profile of the second tube. The outer profile of the first tube may match the inner profile of the second tube. Alternatively, the outer profile of the first tube may be different than the inner profile of the second tube. The inner profile of the second tube, the outer profile of the first tube, or both may be defined by a surface of increasing radius. In some embodiments, at least one of the outer profile of the first tube and the inner profile of the second tube may include a circumferential surface at an increasing radius from an axis of rotation of the tube. The inner profile of the second tube, the outer profile of the first tube, or both may be defined by at least one of an elliptic configuration, a single snail or spiral configuration, a multiple snail or spiral configuration, and an undulating configuration. In some embodiments, the outer surface of the second tube, the inner surface of the first tube, or both may be circular.

In some embodiments, the second tube may be rotationally fixed and the first tube may rotate. In some embodiments, the first tube may rotate eccentrically relative to the second tube.

In some embodiments, the tow handle may include first and second tube structures each including an inner tube slidably or telescopically received within an outer tube. The first and second tube structure may be parallel to each other and may be connected to each other at one end by a hand grip. One or preferably both of the first and second tube structures may be arranged such that rotation of the inner tube relative to the outer tube causes at least a portion of the inner tube to engage a portion of the outer tube to selectively frictionally lock axial movement of the inner tube relative to the outer tube.

Additional embodiments and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure. One of skill in the art will understand that each of the various aspects and features of the disclosure may advantageously be used separately in some instances, or in combination with other aspects and features of the disclosure in other instances.

BRIEF DESCRIPTION OF THE DRAWINGS

The description will be more fully understood with reference to the following figures in which components are not drawn to scale, which are presented as various embodiments of the disclosure and should not be construed as a complete recitation of the scope of the disclosure, characterized in that.

DETAILED DESCRIPTION

According to the present disclosure, an extendable tow (or sometimes called pull) handle is provided that can be frictionally locked at any desired height relative an associated luggage case. As explained below, the tow handle includes one or more tube structures each including a plurality of tubes slidably received within and selectively rotatable relative one another. Relative rotation of the tubes (or parts thereof) selectively couples or binds the tubes together, such as via direct or indirect engagement selectively frictionally locking relative axial movement between the tubes. The selective friction engagement between adjacent tubes may be defined by a collar rotatably coupled to one of the tubes, such as to a stopper associated with one of the tubes. The collar may rotate freely relative the associated tube in a radial direction. The collar, however, may be limited from moving in an axial direction on the associated tube, such as via structure (e.g., one or more ribs) positioned below and above the collar. Rotation of an inner tube may selectively cause the collar to engage an outer tube. Once engaged, the collar may provide sufficient friction between the collar and one of the tubes to inhibit relative axial movement between the two tubes, while limiting radial friction between the collar and the other tube, thus allowing a user to rotate the tubes relatively to more easily disengage the friction engagement at will.

Figure 1:
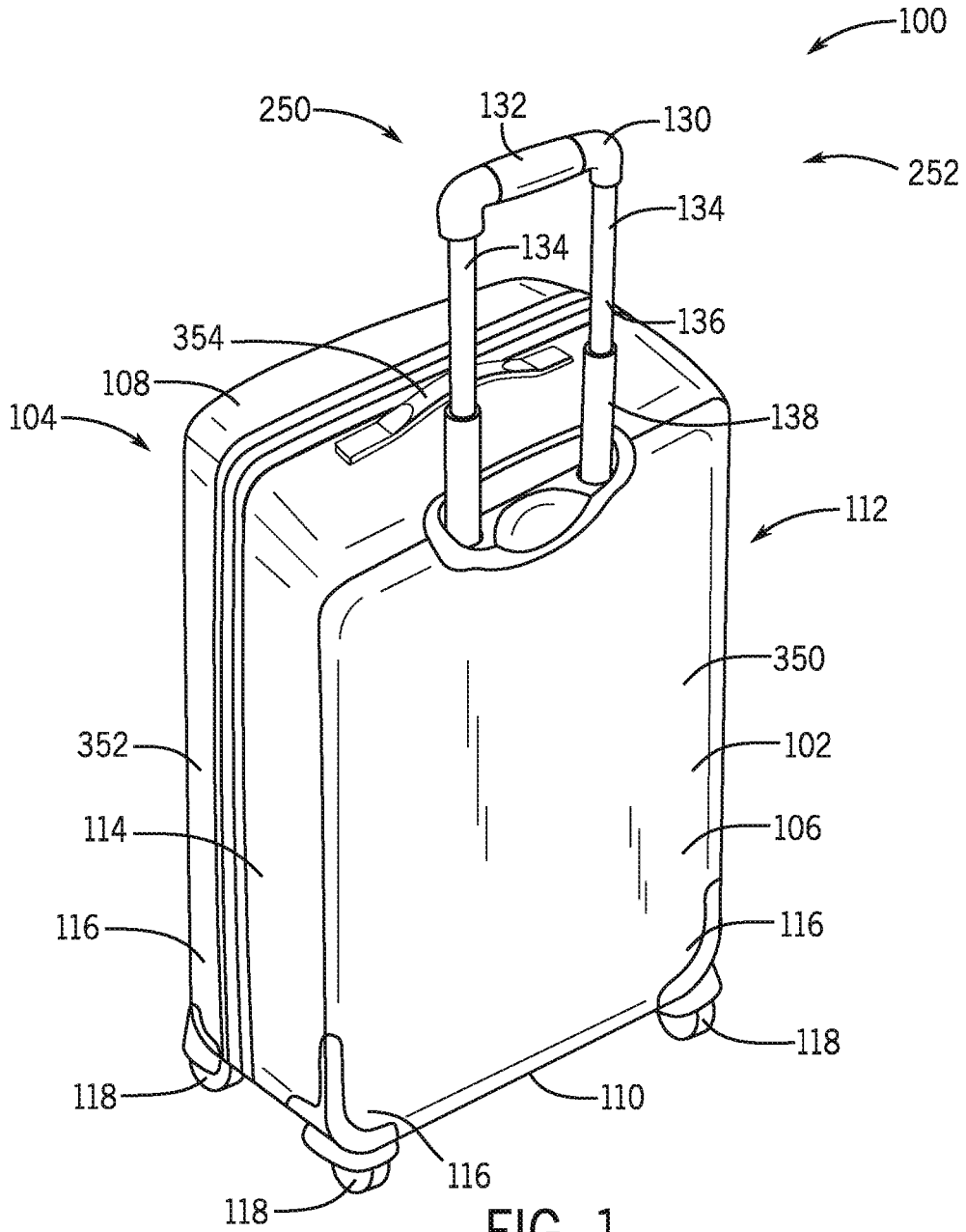
FIG. 1 is a rear isometric view of a luggage article including a tow handle in accordance with some examples of the present disclosure.

Referring to FIG. 1, a luggage article 100 according to an embodiment of the present disclosure includes a luggage case 102 formed from a plurality of walls or panels defining an internal compartment and a storage volume in which to carry a user's belongings. As shown, the luggage article 100 includes opposing front and rear panels 104, 106, opposing top and bottom panels 108, 110, and opposing left and right panels 112, 114 that collectively define the outer structure of the luggage case 102. Corner regions 116 are defined by the intersection of any two or three adjacent panels of the luggage case 102. For example, the luggage case 102 of FIG. 1 includes four lower corner regions 116, each formed by the intersection of the bottom panel 110 with the left and right panels 112, 114 and/or the front and rear panels 104, 106. As shown, a plurality of wheel assemblies 118, which may be spinner wheel assemblies, may be coupled to the luggage case 102. For example, the luggage case 102 may include four wheel assemblies 118 coupled to at least the bottom panel 110, such as at the corner regions 116. The luggage article 100 may also include one or more carry handles 354, typically one on one side (not shown) and another (354) on the top of the luggage article (100) so that it can be carried by a user.

Figure 2:
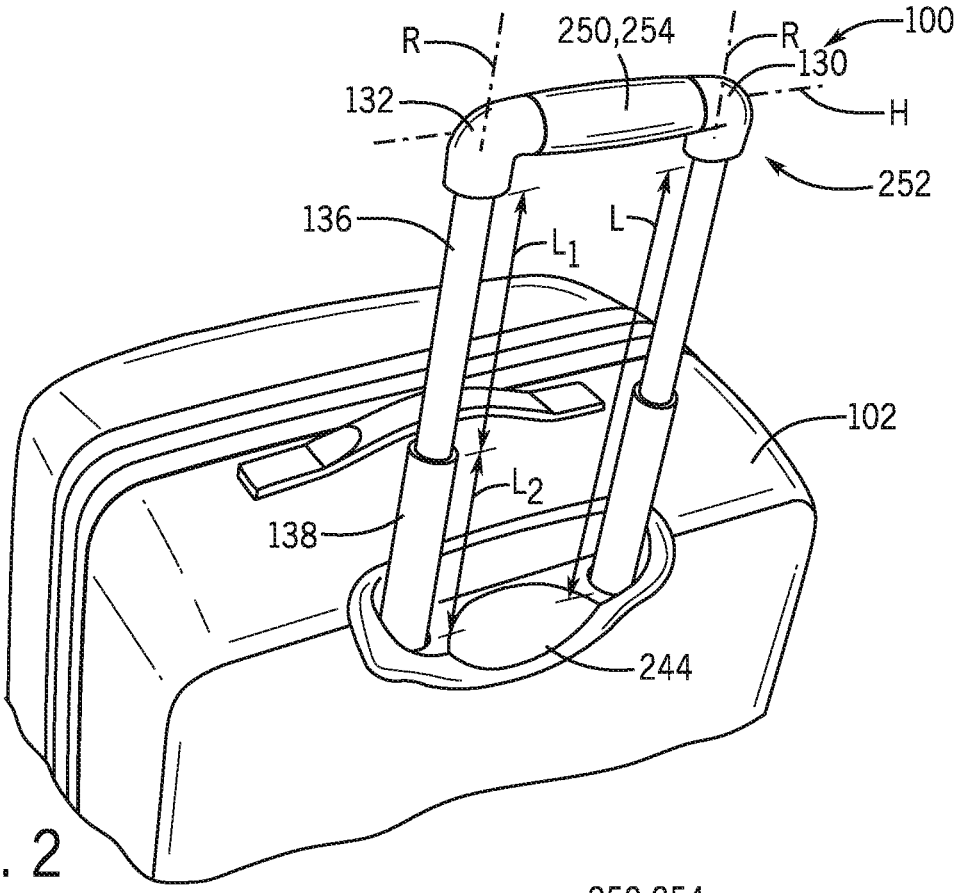
FIG. 2 is an enlarged fragmentary view of the luggage article of FIG. 1 with the dual tube tow handle in an extended position in accordance with some examples of the present disclosure.
Figure 3:
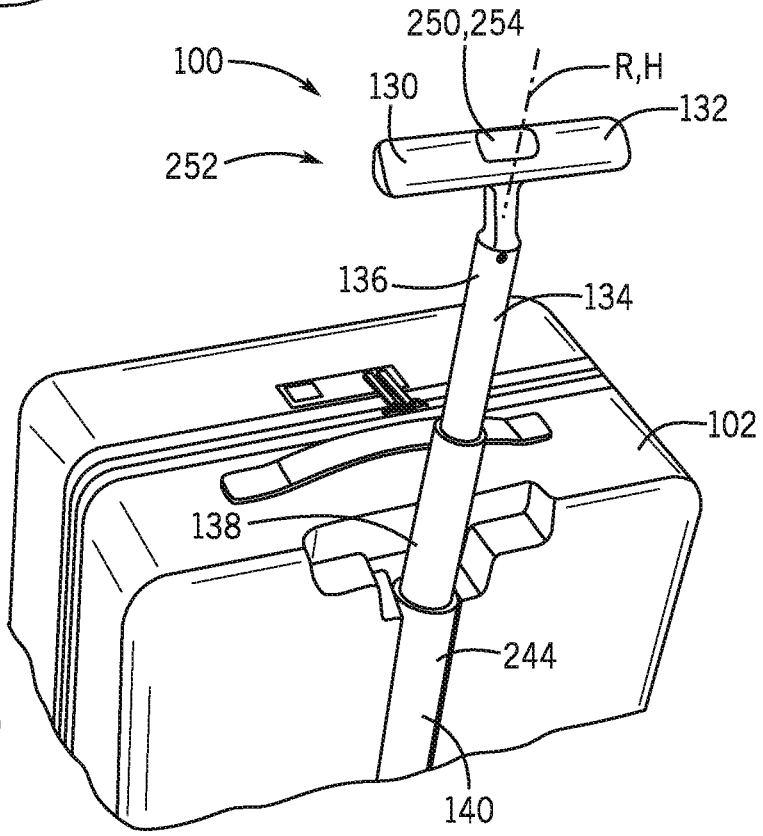
FIG. 3 is an enlarged fragmentary view of the luggage article of FIG. 1 with a single tube tow handle in an extended position in accordance with some other examples of the present disclosure.

With continued reference to FIG. 1, the luggage article 100 also includes an extendable or telescopic tow handle 130 attached to the luggage article 100, and preferably as shown to at least one panel of the luggage case 102, such as to the rear panel 106. As shown, the tow handle 130 includes a hand grip 132 and at least one tube structure 134 (e.g., one tube structure 134 as shown in FIG. 3, two tube structures 134 as shown in FIGS. 1 and 2, or the like) each including a plurality of tubes slidably received within one another. For example, each tube structure 134 includes a first tube 136 and a second tube 138. The first and second tubes 136, 138 are telescopically arranged, such as the first tube 136 slidably received within the second tube 138. In some embodiments, the first and second tubes 136, 138 may be concentrically arranged. Depending on the particular application, any number of tubes is contemplated. For example, with reference to FIGS. 7-10, each tube structure 134 may also include a third tube 140, the second tube 138 slidably received within the third tube 140. This pattern of slidably receiving each tube structure 134 within a successive tube may continue until a particular characteristic is achieved, such as a desired extended length of the tube structure(s) 134 for a particular case size. Unless otherwise noted, the description that follows is directed toward an embodiment including only the first and second tubes 136, 138. Each successive tube (e.g., the third tube 140) may be arranged similarly and may be added in a similar manner. For example, in embodiments including three tubes, the third tube 140 may be arranged similarly to the second tube 138 discussed below, and the second tube 138 may be arranged similarly to the first tube 136 discussed below. In this way, each tube structure 134 may be arranged in a modular fashion without changing the arrangement of the inner tubes, thus decreasing assembly costs and complexity, for instance. Alternatively, only some or two of the tubes may be so arranged with others more conventionally locked in position using locking holes and pins, for example.

Turning to FIGS. 6A-10, each of the first and second tubes 136, 138 is an elongate member including a length $L_1$ and $L_2$, respectively (see FIG. 2). The first tube 136, which may be referred to as an inner tube, includes a wall 150 defining opposing inner and outer surfaces 152, 154. Similarly, the second tube 138, which may be referred to as an outer tube, includes a wall 156 defining opposing inner and outer surfaces 158, 160. As explained below, at least a portion of the first tube 136 may be arranged to selectively couple, such as for example engaging (in further example by directly engaging and/or by indirectly engaging), at least a portion of the second tube 138 to selectively frictionally lock axial movement of the first tube 136 relative to the second tube 138, which may allow a user to tow the luggage article 100 across a support surface. For example, as described more fully below, at least one of the first and second tubes 136, 138 (e.g., at least one of the outer surface 154 of the first tube 136 and the inner surface 158 of the second tube) may include a non-concentric and/or non-rotationally symmetrical profile such that rotation of the first tube 136 relative to the second tube 138 selectively frictionally locks the first and second tubes 136, 138 together. In some embodiments, the first and second tubes 136, 138 may be sized and shaped to be lightweight and/or include increased strength. For instance, each of the first and second tubes 136, 138 may be substantially hollow, formed from a lightweight material (e.g., rigid plastic, aluminum or other lightweight metal, or carbon fiber, among others), arranged to increase torsional and/or flexural strength (e.g., through mechanical cross sectional design), or any combination thereof.

As detailed below, the first and second tubes 136, 138 of each tube structure 134 may move axially relative each other to extend the tow handle 130 a varying distance away from the luggage case 102, such as a varying height above the top panel 108. In such embodiments, each tube structure 134 may be coupled to the luggage case 102 (e.g., to at least the rear panel 106 whether within the internal compartment (see FIG. 2) or along the exterior of the luggage case 102 (see FIG. 3)), with the first tube 136 coupled to the hand grip 132. As detailed below, a user may manipulate the hand grip 132 to slide the first tube 136 relative the second tube 138 to extend or collapse the tow handle 130 as desired. In this manner, sliding the first tube 136 relative the second tube 138 may extend the hand grip 132 a distance away from the luggage case 102 to permit a user to maneuver the luggage article 100 across a support surface (e.g., the ground or floor) such as by grasping the hand grip 132 and pulling the luggage article 100 across the support surface. As detailed below, the first and second tubes 136, 138 may slide relative each other to position the hand grip 132 at any desired distance (e.g., height) away from the luggage case 102 based on user preference or desires and subject to the lengths $L_1$, $L_2$ of the first and second tubes 136, 138. Though the tow handle 130 may include a plurality of tube structures 134, unless otherwise noted, only one tube structure 134 will be discussed for ease of reference. Each tube structure 134 may be configured substantially identically. In some embodiments, a left tube structure 134 may be a mirror image of a right tube structure 134 in orientation and operation. For example, locking the tube structures 134 may be accomplished by rotating the left tube structure one direction (e.g., clockwise) while rotating the right tube structure an opposite direction (e.g., counterclockwise).

At least one of the first and second tubes 136, 138 may include a surface of varying radius such that rotation of the first tube 136 relative the second tube 138 reduces a clearance between the tubes (e.g., between the outer surface 154 of the first tube 136 and the inner surface 158 of the second tube 138) to cause a friction engagement therebetween. As explained below, the friction engagement may lock each tube structure 134 in any desired position between and including a fully extended position and a fully retracted position. In some embodiments, at least one of the first and second tubes 136, 138 may include a non-circular cross-section or profile, such as a single snail or spiral configuration (see FIGS. 4 and 5), a multiple snail or spiral configuration (see FIGS. 15 and 16), an undulating configuration (see FIGS. 17 and 18), an oval or elliptical configuration (see FIGS. 19 and 20), or the like. Additionally or alternatively, the first tube 136 may rotate eccentrically relative to (e.g., within) the second tube 138 to reduce the clearance in a similar manner (see FIGS. 21 and 22).

As described herein, the tube structure 134 may rotate between a sliding arrangement (see FIGS. 4, 7, 15, 17, 19, and 21, for instance) and a locking arrangement (see FIGS. 5, 9, 16, 18, 20, and 22, for instance). As explained more fully below, in the sliding arrangement, the first tube 136 moves axially relative the second tube 138 to either increase or decrease a length L of the tube structure 134 (see FIG. 2). Once positioned at a desired length, the first tube 136 may be rotated in a first direction (e.g., clockwise in FIG. 5) to the locking arrangement to reduce the clearance between the first and second tubes 136, 138 and secure the first and second tubes 136, 138 together by, for instance, limiting axial movement of the first tube 136 relative the second tube 138. As explained below, the first tube 136 may be rotated in a second direction (e.g., counterclockwise in FIG. 5) to the sliding arrangement to increase the clearance between the first and second tubes 136, 138 and permit the tubes 136, 138 to slide relative each other. When frictionally locked, the first and second tubes 136, 138 may engage each other along a substantial portion of the length L of each tube structure 134, or may engage each other along only a small portion of the length L of each tube structure 134, or may engage each other along more than one portions of the length L of each tube structure 134.

Figure 4:
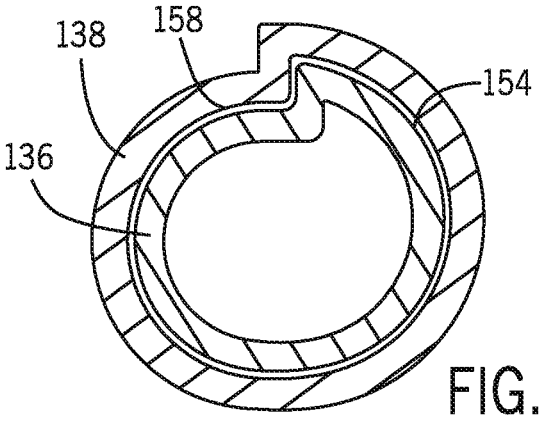
FIG. 4 is a transverse cross-sectional view of a tow handle in a sliding arrangement in accordance with some examples of the present disclosure.
Figure 5:
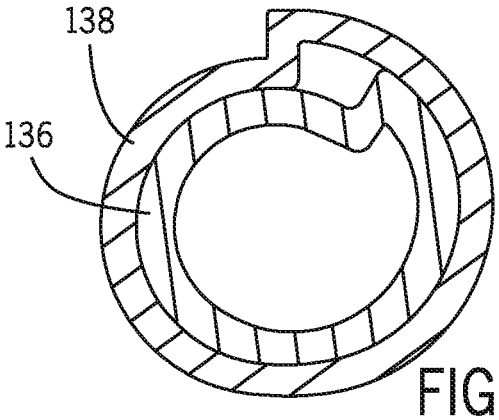
FIG. 5 is a transverse cross-sectional view of the tow handle of FIG. 4 in a locking arrangement in accordance with some examples of the present disclosure.

FIGS. 4 and 5 illustrate one example of a friction engagement between at least a portion of the length of each of the first and second tubes 136, 138. In the embodiments of FIGS. 4 and 5, at least a portion of the outer surface 154 of the first tube 136 may be arranged to directly engage at least a portion of the inner surface 158 of the second tube 138, such as frictionally, meshingly, interferingly, or the like. The portions or each tube that may engage one another may be substantially the entire length of the tube, or may be only a relatively short length of the tube. The engagement of these respective portions of the first tube 136 and second tube 138 create a friction interface to, in this example, inhibit relative axial movement.

The cross-sectional profile of each of tube may define a varying radius around the tube circumference, shown in this example as a spiral or "snail-shape" or also known as an "ammonite shape" with the inner and outer surfaces of each tube having the same profile. In other examples, the inner and outer surfaces may differ in shape, resulting in different profiles. For instance, the inner surface of the second tube 138 may have a snail-shape profile, and the outer surface of the second tube may have a circular profile. Likewise, the outer surface of the first tube 136 may have a snail-shape profile, and the inner surface of the first tube 136 may have a circular profile. The entire circumference of a tube may form a profile shape having a varying radius, or only a portion of the circumference of a tube may form a profile shape having a varying radius.

In such embodiments, the varying radius of the outer surface of the first tube 136 may be arranged to reduce the clearance between it and the inner surface of the second tube 138 such that upon rotation of the first tube 136 relative the second tube 138, these relative surfaces engage. In this manner, rotation of one of the first and second tubes 136, 138 relative to the other selectively frictionally binds the tubes 136, 138 together (see FIG. 5) to a sufficient degree to allow a user to pull a luggage case with the tow handle. To axially move the first tube 136 relative the second tube 138 and adjust the length of the tow handle, the first and second tubes 136, 138 may be rotated into alignment (see FIG. 4) to release the friction engagement between the tubes.

Figure 6A:
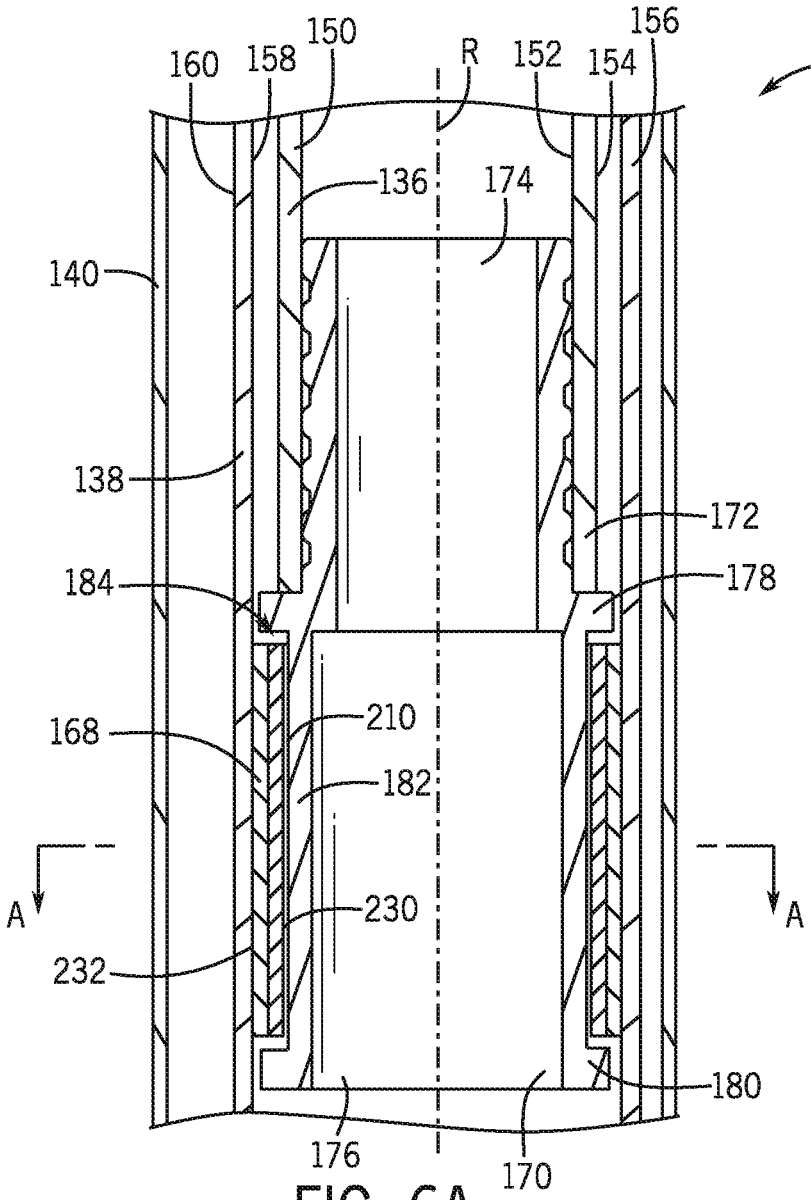
FIG. 6A is a longitudinal cross-sectional view of a tow handle in accordance with some examples of the present disclosure.

FIGS. 6A-10 illustrate another example of a friction engagement between the first and second tubes 136, 138. With reference to FIGS. 6A and 6B, each tube structure 134 may include a first friction member or collar 168 positioned radially between the first and second tubes 136, 138. The first collar 168 is rotatably coupled to one of the first and second tubes 136, 138 and selectively engageable with the other of the first and second tubes 136, 138 to create the selective friction engagement therebetween. As shown in FIGS. 6A and 6B, the selective frictional engagement between the first and second tubes 136, 138 may include a first interface between the first collar 168 and one of the first and second tubes 136, 138 (e.g., between the first collar 168 and the first tube 136), and a second interface between the first collar 168 and the other of the first and second tubes 136, 138 (e.g., between the first collar 168 and the second tube 138). The first interface, which may be referred to as a low friction interface, may include a first coefficient of friction, and the second interface, which may be referred to as a high friction interface, may include a second coefficient of friction. Depending on the particular application, the first and second coefficients of friction may be equal or different, such as the second coefficient of friction being greater than the first coefficient of friction, or vice-versa. For instance, in one embodiment, the second coefficient of friction may be configured to limit axial movement of the first collar 168 relative one of the tubes (e.g., relative to the second tube 138) whereas the first coefficient of friction may be configured to permit radial movement of the first collar 168 relative the other tube (e.g., relative the first tube 136), or vice-versa.

To at least limit disengagement of the first collar 168 from the first and second tubes 136, 148, the tow handle 130 may include means for axially locating the first collar 168 along a portion of either the first or second tube 136 or 138. For instance, the tow handle 130 may include a stopper, e.g., a first stopper 170, associated with a portion of the first or second tube 136 or 138, such as associated with (e.g., coupled to) a lower end 172 of the first tube 136 (see FIG. 6A) or associated with (e.g., integrally formed with) an upper end 173 of the second tube 138 (see FIG. 6B). As explained below, the stopper (e.g., the first stopper 170) positions the first collar 168 along the axial length of either the first or second tube 136 or 138. As explained below, the first stopper 170 may limit axial movement of the first collar 168 relative to either the first or second tube 136 or 138. The first stopper 170 may be formed integrally as part of the first or second tube 136 or 138, or may be a separate component coupled with the first or second tube 136 or 138. Though the first stopper 170 may be associated with the second tube 138, for ease of reference, the first stopper 170 will be described below associated with the first tube 136. Though the first collar 168 is described as associated with the first stopper 170, the first collar 168 may be associated directly with the first or second tube 136 or 138 in a similar manner. Accordingly, any description of the first stopper 170 may apply to the structure of the first or second tube 136 or 138.

In the embodiment of FIG. 6A, the first stopper 170, which may be aligned axially with the first tube 136, may include opposing first and second portions 174, 176. The first portion 174, which may be referred to as an interior portion, may be received within the first tube 136 (e.g., within the lower end 172 of the first tube 136), such as through friction or interference fit, for instance, such that rotation of the first tube 136 causes corresponding rotation of the first stopper 170. In such embodiments, the second portion 176, which may be referred to as an exterior portion, may abut the lower end 172 of the first tube 136. As shown, the first stopper 170 (e.g., the second portion 176 of the first stopper 170) includes an upper rib 178, a lower rib 180, and an engagement cylinder 182 extending between the upper and lower ribs 178, 180. The upper and lower ribs 178, 180 may be sized annularly larger than the engagement cylinder 182 to define an annular recess 184 therebetween (see FIG. 6A). Should the first stopper 170 be associated with the second tube 138, the upper and lower ribs 178, 180 may be sized annularly smaller than the engagement cylinder 182 to define the annular recess 184 therebetween (see FIG. 6B). Though shown and described as coupled to the first tube 136 in FIG. 6A and formed integrally with the second tube 138 in FIG. 6B, the first stopper 170 may be formed integrally with the first tube 136 as a single element or coupled to the second tube 138. Having the first stopper 170 as a separate element, however, may allow the friction engagement to be applied to any type of tube and/or to tubes of substantially any cross-sectional shape, for instance. Alternatively the first and second portions 174, 176 may be formed integrally with the first or second tubes, and accordingly the upper and lower ribs 178, 180.

Figure 6B:
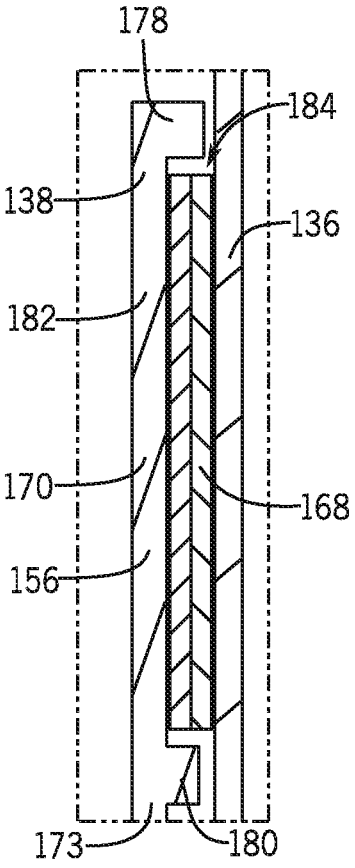
FIG. 6B is a longitudinal cross-sectional view of an additional tow handle in accordance with some examples of the present disclosure.
Figure 7:
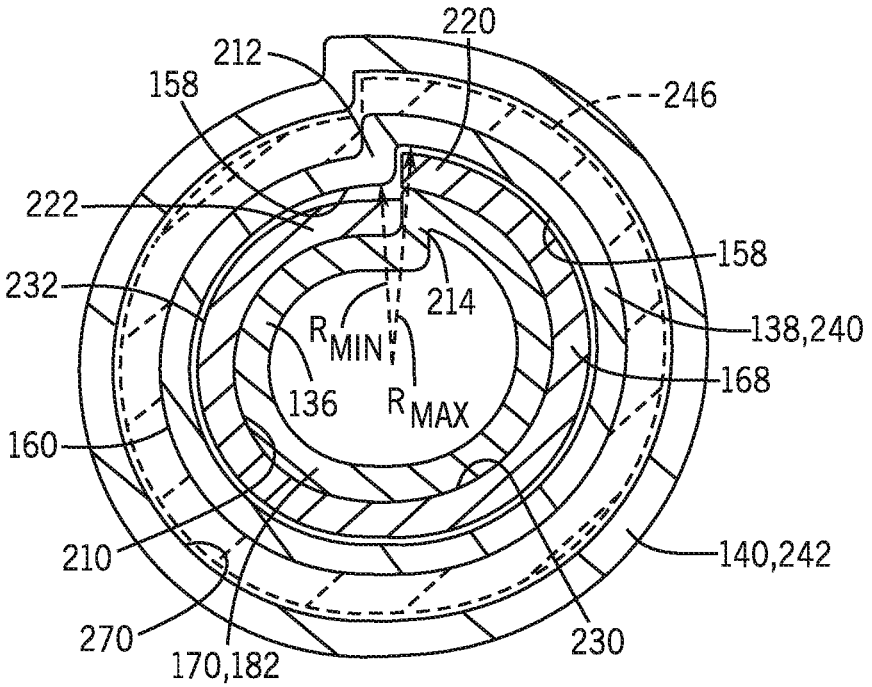
FIG. 7 is a transverse cross-sectional view of the tow handle of FIG. 6A take along section line A-A in accordance with some examples of the present disclosure.

As shown in FIGS. 6A and 6B, the annular recess 184 may be sized and shaped to receive the first collar 168 therein. During axial sliding movement of the first tube 136 relative the second tube 138, the upper and lower ribs 178, 180 may limit disengagement of the first collar 168 from the first stopper 170 such that the first collar 168 slides correspondingly with the first stopper 170. To properly position the first stopper 170 relative the first tube 136, for instance, the upper rib 178 may abut the lower end 172 of the first tube 136. Additionally or alternatively, the upper rib 178 may be sized annularly larger than the wall 150 of the first tube 136 to limit disengagement of the first tube 136 from the second tube 138 and/or define the selectively longest extension of the first tube 136 relative the second tube 138. For example, to limit disassembly of the first and second tubes 136, 138, the upper rib 178 may engage a limit stop defined on the second tube 138. The limit stop may be defined by an annular constriction, post, tab, or the like defined on the inner surface 158 of the second tube 138, by a bushing positioned on an end of the second tube 138, or the like.

In the embodiments of FIGS. 7-10, each of the second tube 138 and the engagement cylinder 182 of the first stopper 170 includes a non-circular cross-section profile (e.g., a snail-type cross-section) such that an outer surface 210 of the engagement cylinder 182 and the inner surface 158 of the second tube 138 defines a varying radius of the respective members. For example, with reference to FIG. 7, the inner surface 158 of the second tube 138 may be defined in part by a limit wall 212 extending at least partially along a radius line of the second tube 138 so the inner surface 158 includes a smallest radius $R_{MIN}$ and a largest radius $R_{MAX}$. Similarly, the outer surface 210 of the engagement cylinder 182 may be defined in part by an abutment wall 214 extending at least partially along a radius line of the engagement cylinder 182 so the engagement cylinder 182 includes a smallest outer diameter $OD_{MIN}$ and a largest outer diameter $OD_{MAX}$ (see FIG. 9). Due to at least the non-circular shape of the engagement cylinder 182, the gap between the outer surface 232 of the first collar 168 and the second tube 138 may reduce as the first tube 136 rotates relative the second tube 138. As the outer surface 232 of the first collar 168 engages the inner surface 158 of the second tube 138, the first collar 168 will no longer rotate, and as the engagement cylinder 182 rotates further, the engagement between the first collar 168 and the inner surface 158 of the second tube 138 will be increased, such as via expansion of the first collar 168 in one embodiment, thus increasing the friction between the second tube 138 and the first collar 168. For example, as detailed below, rotation of the first tube 136 relative the second tube 138 selectively expands the first collar 168 to sandwich the first collar 168 between the outer surface 210 of the engagement cylinder 182 and the inner surface 158 of the second tube 138 to secure the first and second tubes 136, 138 together.

The inner surface 158 of the second tube 138 may correspond, either generally or exactly, with the outer surface 210 of the engagement cylinder 182 (but may be slightly radially larger and spaced therefrom in the unlocked position) such that rotation of the first stopper 170 relative the second tube 138 then provides sufficient surface engagement between the first stopper 170, the first collar 168, and the second tube 138. In some embodiments, the outer surface 210 of the engagement cylinder 182 may be substantially parallel to the inner surface 158 of the second tube 138, thus providing the greatest amount of surface engagement between the first stopper 170 and the first collar 168, and between the first collar 168 and the second tube 138, as explained below. In some embodiments, the inner surface 158 of the second tube 138 may be non-parallel to the outer surface 210 of the engagement cylinder 182 such that a radial distance between the inner surface 158 of the second tube 138 and the outer surface 210 of the engagement cylinder 182 varies at different rotational positions about the first stopper 170. To account for a non-parallel relationship between the inner surface 158 of the second tube 138 and the outer surface 210 of the engagement cylinder 182, the first collar 168 may include a varying thickness and radius. In such embodiments, the reduction in thickness may be less than the reduction in radius. As shown, the first collar 168 includes a spring action towards the first stopper 170. That is, absent an expansion force provided by the first stopper 170, the first collar 168 may be biased to constrict away from the inner surface 158 of the second tube 138 and against the outer surface 210 of the first stopper 170, as detailed more fully below.

The first collar 168 may be sized and shaped to substantially match the cross-sectional shapes of the first tube 136, the first stopper 170, and/or the second tube 138. In the embodiments of FIGS. 7-10, the first collar 168 includes a snail-type cross-section such that the first collar 168 may be positioned between the first tube 136 (e.g., the engagement cylinder 182) and the second tube 138. As explained below, selective rotation of the first tube 136 (e.g., the first stopper 170) relative the first collar 168 may cause the first collar 168 to selectively engage both the inner surface 158 of the second tube 138 and the outer surface 210 of the engagement cylinder 182. In the embodiments shown, the first collar 168 is a band spring like member including opposing first and second free ends 220, 222 engageable with the limit wall 212 of the second tube 138 and the abutment wall 214 of the engagement cylinder 182, respectively. For instance, the first free end 220 may abut the limit wall 212 and the second free end 222 may abut the abutment wall 214 to define the sliding arrangement of each tube structure 134. When positioned in the locking arrangement, the first tube 136 may be rotated such that the abutment wall 214 of the first stopper 170 is spaced away from the second free end 222 of the first collar 168 to define a space therebetween (see FIGS. 8 and 9). Additionally or alternatively, the first collar 168 may rotate relative the second tube 138 such that the first free end 220 is spaced away from the limit wall 212 of the second tube 138 to define an additional space therebetween (see FIGS. 9 and 10).

With continued reference to FIGS. 7-10, the first collar 168 may include an inner surface 230 and an outer surface 232. The inner surface 230 is arranged to engage the outer surface 210 of the engagement cylinder 182, and the outer surface 232 is arranged to engage the inner surface 158 of the second tube 138. In some embodiments, the outer surface 232 of the first collar 168 may be substantially parallel to the inner surface 158 of the second tube 138, at least when the tube structure 134 is positioned in the sliding arrangement. Similarly, the inner surface 230 of the first collar 168 may be substantially parallel to the outer surface 210 of the engagement cylinder 182 to provide sufficient engagement between the engagement cylinder 182 and the first collar 168, and between the first collar 168 and the second tube 138.

The inner surface 230 of the first collar 168 may include a first coefficient of friction, which may be a low coefficient of friction, such as being formed from or coated with a low friction material (e.g., polyamide, polyoxymethylene (POM), or the like). The outer surface 232 of the first collar 168 may include a second coefficient of friction, which may be a high coefficient of friction, such as being formed from or coated with a high friction material (e.g., thermoplastic polyurethane (TPU), etc.). Additionally or alternatively, the inner surface 230 of the first collar 168 may be polished, and the outer surface 232 of the first collar 168 may be roughened such that the inner and outer surfaces 230, 232 include different roughness. The first and second coefficients of friction may be equal or may differ to provide a desired functional characteristic. For example, the second coefficient of friction may be greater than the first coefficient of friction to provide different friction characteristics between the first collar 168 and the first stopper 170 and between the first collar 168 and the second tube 138. As such, when the tube structure 134 is positioned in the locking arrangement, the first collar 168 may slide about or relative the engagement cylinder 182 with relative ease whereas sliding movement of the second tube 138 relative the first collar 168 is relatively difficult, as more fully explained below. In this manner, once the tube structure 134 is positioned in the locking arrangement, the first collar 168 may limit or inhibit axial sliding of the first tube 136 relative the second tube 138 while simultaneously permitting the first tube 136 to rotate relative the second tube 138 to disengage the friction engagement between the first and second tubes 136, 138 at will. In other words, the first collar 168 may be arranged to provide sufficient friction between the first collar 168 and the second tube 138, such as in a vertical direction to resist axial movement, while limiting radial friction between the first tube 136 and the first collar 168, to allow relative rotation.

Referring to FIGS. 7-10, in embodiments including more than two tubes, such as a third tube 140 slidably receiving the second tube 138, the tube structure 134 may include a second stopper 240 coupled to the second tube 138 (e.g., to a lower end of the second tube 138) for selective engagement with the third tube 140. In some embodiments, the tube structure 134 may include a third stopper 242 coupled to the third tube 140 (e.g., to a lower end of the third tube 140). The second stopper 240 may be arranged similar to the first stopper 170 to create a friction engagement between the second and third tubes 138, 140. The third stopper 242 may be arranged similar to the first and second stoppers 170, 240 to create a friction engagement between the third tube 140 and the luggage case 102 (e.g., between the third tube 140 and a tow handle housing 244 (see FIGS. 2 and 3)). For example, the second and third stoppers 240, 242 may include a second friction member or collar 246 and a third friction member or collar 248, respectively, similar to the first collar 168. For example, the second collar 246 may be arranged to selectively limit or inhibit axial sliding of the second tube 138 relative the third tube 140 while simultaneously permitting the second tube 138 to rotate relative the third tube 140 to disengage the friction engagement between the second and third tubes 138, 140 at will. Similarly, the third stopper 242 and/or third collar 248 may be arranged to selectively limit or inhibit axial sliding of the third tube 140 relative the luggage case 102 (i.e., relative the tow handle housing 244) while simultaneously permitting the third tube 140 to rotate relative the luggage case 102 to disengage the friction engagement between the third tube 140 and the luggage case 102 at will. In some embodiments, the third tube 140 may be fixed relative the luggage case 102, such as attached to the tow handle housing 244, a bottom kick plate, an internal frame of the luggage case 102, or the like. In such embodiments, the lower end of the third tube 140 may be swaged to include a different cross-section (e.g., a square cross-section) to facilitate fixed attachment to the luggage case 102. As explained below, the friction engagements between the second and third tubes 138, 140 and between the third tube 140 and the luggage case 102 may be timed sequentially with the friction engagement between the first and second tubes 136, 138. In some embodiments, the first, second, and third tubes 136, 138, 140 may be positioned in the sliding and locking arrangements at substantially the same time or in substantially any order.

Referring to FIGS. 1-3, the tow handle 130 may include a lock mechanism 250 associated with at least two of the plurality of tubes (e.g., with the first and second tubes 136, 138) to create the friction engagement therebetween. Additionally or alternatively, the lock mechanism 250 may be operable to position the tube structure(s) 134 between the sliding and locking arrangements. The lock mechanism 250 may include the hand grip 132, or alternatively may include the hand grip 132 and a biasing assembly 252, the biasing assembly 252 operable to bias each tube structure 134 to the locking arrangement. In the embodiments of FIG. 2, the hand grip 132 may be coupled to the first tube 136 and arranged to rotate about an axis H extending at, or also oriented at, an angle to the tube structure(s) 134. In some embodiments, the axis H may be substantially orthogonal, less than orthogonal, or greater than orthogonal to an axis of rotation R of the tube structure(s) 134 (see FIG. 2). Each of the first tube 136 and the second tube 138 includes a rotation axis, the rotation axes of the first and second tubes 136, 138 preferably defining the axis of rotation R. In other less preferred embodiments, the axis of rotation R may not be the same as one or both axes of the first and second tubes 136, 138. Also, the axis of the first tube 136 may not be common with the axis of the second tube 138 such that when one of the first and second tubes 136, 138 rotates it engages the other to provide the selective engagement preventing or restricting relative axial movement of the tubes. As explained below, rotation of at least a portion of the hand grip 132 about the axis H preferably causes corresponding rotation of each tube structure 134 (e.g., the first tube 136) about the axis R. For example, rotation of at least a portion of the hand grip 132 about the axis H may rotate the first tube 136 about the axis R to either engage or disengage the first collar 168 with the inner surface 158 of the second tube 138. Similarly, when the first collar 168 is engaged with the second tube 138, continued rotation of the hand grip 132 about the axis H may rotate the second tube 138 about the axis R to either engage or disengage the second collar 246 with the inner surface of the third tube 140. In such embodiments, the hand grip 132 may rotate about the axis H a certain degree per tube section to either engage and/or disengage the friction engagement between the tubes. For instance, the hand grip 132 may rotate about the axis H between about 15 degrees and about 45 degrees (preferably about 30 degrees) per friction engagement. For example, the hand grip 132 may rotate about 30 degrees to engage or disengage the friction engagement between the first and second tubes 136, 138. The hand grip 132 may rotate about the axis H another 30 degrees to engage or disengage the friction engagement between the second and third tubes 138, 140, as detailed more fully below. To lock the tube structure (s) 134, the hand grip 132 may rotate about the axis H in a first rotational direction (e.g., clockwise in FIG. 23). To unlock the tube structure(s) 134, the hand grip 132 may rotate about the axis H in a second rotational direction (e.g., counterclockwise in FIG. 23).

Figure 11:
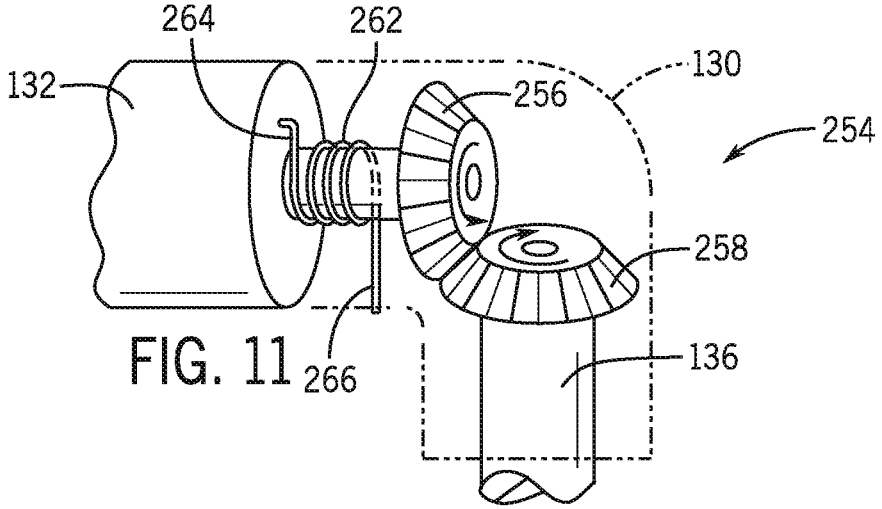
FIG. 11 is a perspective view of a locking mechanism in accordance with some examples of the present disclosure.
Figure 14:
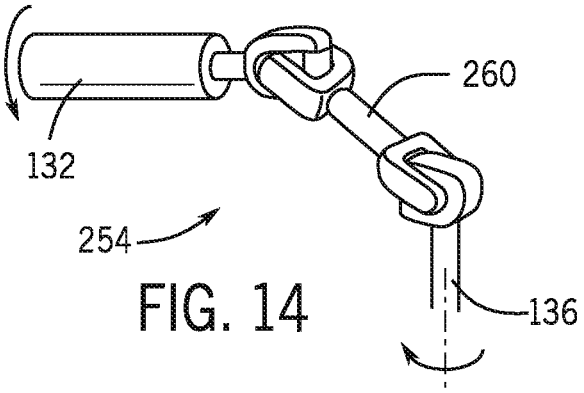
FIG. 14 is a perspective view of an additional locking mechanism in accordance with some examples of the present disclosure.

In some embodiments, the hand grip 132 may include a rotational mechanism 254 operable to rotate the first tube 136 relative to the second tube 138, such as upon actuation of the hand grip 132. As described herein, at least a portion of the hand grip 132 may move (e.g., rotate, slide, and/or depress, among others) to actuate the rotational mechanism 254. For example, referring to the embodiments of FIGS. 11 and 14, the rotational mechanism 254 may include a bevel gear or universal joint arrangement, respectively. As shown in FIG. 11, the rotational mechanism 254 may include a first gear 256 coupled to a movable portion of the hand grip 132 (e.g., to a rotatable grip portion), and a second gear 258 coupled to the first tube 136. In such embodiments, the first gear 256 may be arranged to meshingly engage the second gear 258 such that rotation of one rotates the other. Each of the first and second gears 256, 258 may be shaped conically and arranged approximately 90 degrees apart, though other angles between the first and second gears 256, 258 are contemplated depending on the particular application. Referring to FIG. 14, a movable portion of the hand grip 132 may be coupled to the first tube 136 via a universal joint structure 260. In such embodiments, the universal joint structure 260 may transmit rotary movement of at least a portion of the hand grip 132 to the first tube 136 irrespective of the orientation of the hand grip 132 to the first tube 136.

The biasing assembly 252 may bias the hand grip 132 to rotate in the first rotational direction to bias each tube structure 134 towards the locking arrangement. For example, the biasing assembly 252 may include a radial or torsion spring 262 arranged to bias the hand grip 132 to rotate in the first rotational direction (see FIG. 11). In such embodiments, the torsion spring 262 includes a first end 264 anchored to the movable portion of the hand grip 132, and a second end 266 anchored to another portion of the tow handle 130, such as to a fixed portion of the hand grip 132 or to a portion of the tube structure(s) 134, such as to the outermost tube (e.g., to the second or third tube 138, 140). The torsion spring 262 may provide a locking torque sufficient to maintain the friction engagement(s) between the tubes. For example, the torsion spring 262 may provide a torque between about 2 N·m and about 10 N·m (preferably about 5 N·m). To unlock the tube structure(s) 134, a user may provide an unlocking torque greater than the locking torque provided by the torsion spring 262 to cause the hand grip 132 to rotate in the second rotational direction, as detailed below.

Figure 23:
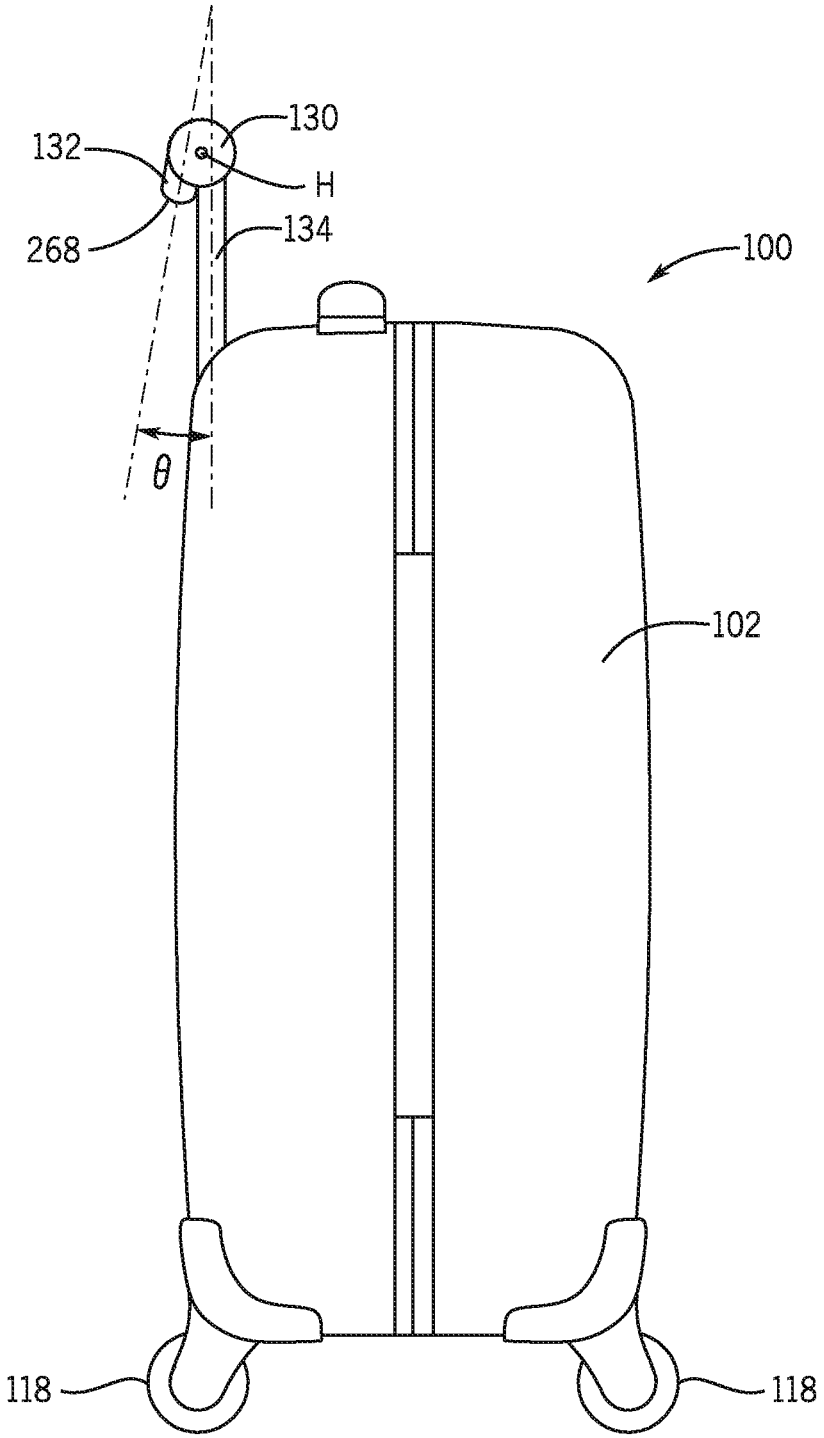
FIG. 23 is a side view of the luggage article of FIG. 1 in accordance with some examples of the present disclosure.

As shown in FIG. 23, the hand grip 132, which may include a knob 268, may include a rest position in which each tube structure 134 is positioned in the locking arrangement. The rest position may be defined by the engagement between the hand grip 132 and the tube structure(s) 134 and/or the friction engagement between the tubes. In the rest position, the hand grip 132 may be rotated away from the tube structure(s) 134 such that an angle θ is defined between the tube structure(s) 134 and the knob 268 to, for instance, position the hand grip 132 in an ergonomic position for rotation. As shown, the angle θ may be between about 5 degrees and about 15 degrees (preferably about 10 degrees) depending on the particular application. In such embodiments, the hand grip 132 may be rotated away from the tube structure(s) 134 (i.e., clockwise in FIG. 23) to position the tube structure(s) 134 in the sliding arrangement. The angle θ may be configured such that a user grasping the hand grip 132 while traversing the luggage article 100 across a support surface maintains the tube structure(s) 134 in the locking arrangement. For example, due to at least the positioning of the knob 268, when a user tilts the luggage article 100 for traversal across a support surface, grasping the hand grip 132 may induce a tendency of the hand grip 132 to rotate in the first rotational direction to lock the tube structure(s) 134. Of course, while the addition of the knob 268 assists in this and is preferred, the knob 268 is not essential for some other less preferred embodiments. Additionally or alternatively, the torsion spring 262 may be sized and shaped to resist rotation of the hand grip 132 in the first rotational direction while a user traverses the luggage article 100 across a support surface. In each embodiment, the user may rotate the hand grip 132 in the second rotational direction, such as rotating the knob 268 away from the rear panel 106 of the luggage case 102, to overcome the bias of the torsion spring 262 to unlock and adjust the length of the tube structure(s) 134 as desired. Upon release of the hand grip 132 by the user, the torsion spring 262 rotates the hand grip 132 in the first rotational direction to auto-lock the tube structure(s) 134 in place. In this manner, a user may quickly and easily reconfigure the tow handle 130 to position the hand grip 132 at any desired height above or away from the luggage case 102

Figure 8:
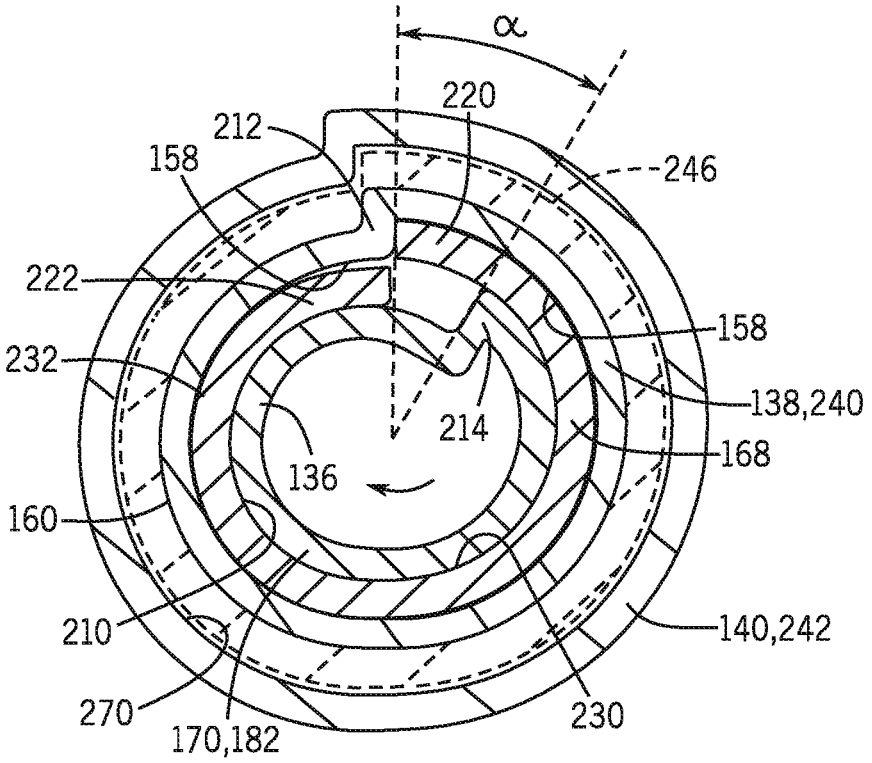
FIG. 8 is an additional transverse cross-sectional view of the tow handle of FIG. 6A taken along section line A-A in accordance with some examples of the present disclosure.

Operation of the tow handle 130 will now be discussed in more detail. To position each tube structure 134 in the locking arrangement, the first tube 136 may be rotated in the first direction, such as via the bias of the torsion spring 262, which causes corresponding rotation of the first stopper 170. As noted above, the first stopper 170 (i.e., the engagement cylinder 182) may rotate freely within the first collar 168 due to at least the low friction material/coating of or on the inner surface 230 of the first collar 168. As the first stopper 170 rotates within the first collar 168 in the first direction, the varying radius of the engagement cylinder 182 reduces the gap between the outer surface 232 of the first collar 168 and the second tube 138 until, for example, the first collar 168 no longer rotates due to at least the engagement of the outer surface 232 of the first collar 168 with the inner surface 158 of the second tube 138. Continued rotation of the first stopper 170 in the first direction may increase abutment of at least a portion of the first collar 168 into engagement with the inner surface 158 of the second tube 138, thus increasing the friction between the second tube 138 and the first collar 168. As shown in FIG. 8, the first stopper 170 may rotate a locking angle α to engage the first collar 168 with the second tube 138. The locking angle α may be between about 15 degrees and about 45 degrees (preferably about 30 degrees). Once engaged with the second tube 138, the outer surface 232 of the first collar 168 limits or inhibits movement of the first collar 168 relative the second tube 138, thus limiting or inhibiting movement of the first tube 136 relative the second tube 138. For example, the engagement between the first collar 168 and the second tube 138 may limit or inhibit axial (e.g., vertical) movement of the first tube 136 relative the second tube 138.

Figure 9:
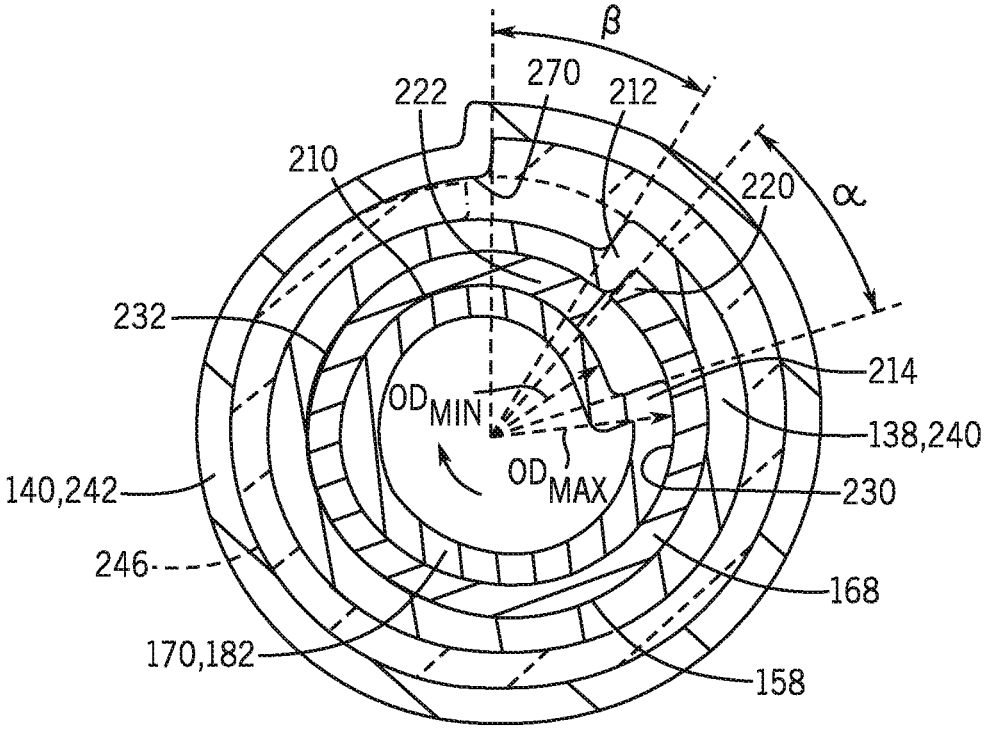
FIG. 9 is an additional transverse cross-sectional view of the tow handle of FIG. 6A take along section line A-A in accordance with some examples of the present disclosure.
Figure 10:
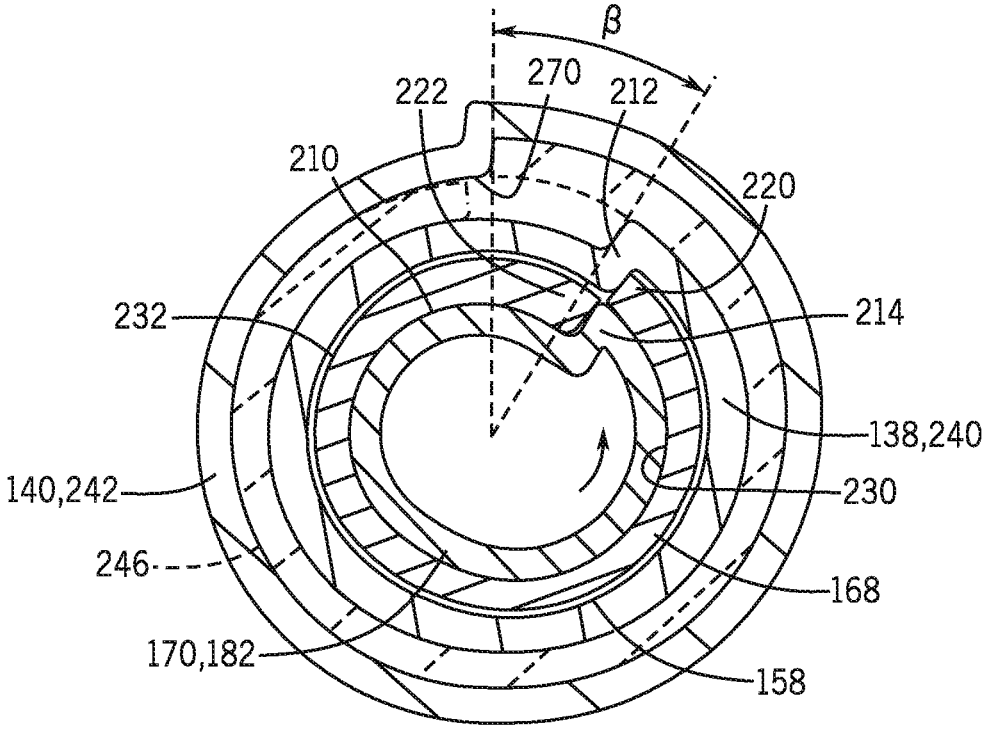
FIG. 10 is an additional transverse cross-sectional view of the tow handle of FIG. 6A take along section line A-A in accordance with some examples of the present disclosure.

Once the first and second tubes 136, 138 are secured together, continued rotation of the first tube 136 in the first direction causes the second tube 138 to rotate correspondingly. Rotation of the second tube 138 causes the second stopper 240 to rotate similar to the first stopper 170. As the second stopper 240 rotates within the second collar 246, the varying radius of the second stopper 240 reduces the gap between the outer surface of the second collar 246 and the third tube 140 until, for example, the second collar 246 no longer rotates due to at least the engagement of the outer surface of the second collar 246 with an inner surface 270 of the third tube 140. Continued rotation of the second stopper 240 in the first direction may cause the second collar 246 to further engage, such as by expansion, the inner surface 270 of the third tube 140, thus increasing the friction between the second collar 246 and the third tube 140. As shown in FIG. 9, the second stopper 240 may rotate a locking angle β to engage the second collar 246 with the third tube 140, the locking angle β being between about 15 degrees and about 45 degrees (preferably about 30 degrees). In some embodiments, the locking angle β may be substantially identical to the locking angle α. Once engaged with the third tube 140, the outer surface of the second collar 246 limits or inhibits movement of the second collar 246 relative the third tube 140, thus limiting or inhibiting movement of the second tube 138 relative the third tube 140. For example, the engagement between the second collar 246 and the third tube 140 may limit or inhibit axial (e.g., vertical) movement of the second tube 138 relative the third tube 140, which may releasably lock each tube structure 134 at a desired position.

In embodiments wherein the third tube 140 is not fixedly attached to the luggage case 102, once the first, second, and third tubes 136, 138, 140 are secured together, continued rotation of the first tube 136 in the first direction causes the third tube 140 to rotate correspondingly. Rotation of the third tube 140 causes the third stopper 242 to rotate similar to the first and second stoppers 170, 240. For instance, rotation of the third stopper 242 in the first direction may cause the third collar 248 to expand outward and into engagement with an outer tube or a portion of the luggage case 102 (e.g., with a portion of the tow handle housing 244). Additionally or alternatively, rotation of the third stopper 242 may cause the third stopper 242 to engage the luggage case 102 directly. Once engaged with the luggage case 102, the third collar 244 and/or third stopper 242 limits or inhibits movement of the third tube 140 relative the luggage case 102. For instance, the engagement between the third collar 244 and/or third stopper 242 with the luggage case 102 may limit or inhibit axial (e.g., vertical) movement of the third tube 140 relative the luggage case 102, thus releasably securing each tube structure 134 at a desired position.

Unlocking each tube structure 134 may be accomplished in substantially the reverse order described above. For instance, to position each tube structure 134 in the sliding arrangement, a user may actuate the rotational mechanism 254 of the hand grip 132 to rotate the first tube 136 in the second direction, which causes corresponding rotation of the first stopper 170. Due to at least the low friction material/coating of or on the inner surface 230 of the first collar 168, the first stopper 170 may rotate within the first collar 168 when the first collar 168 is engaged to the second tube 138. As the first stopper 170 rotates within the first collar 168 in the second direction, the varying radius of the engagement cylinder 182 causes the first collar 168 to constrict away from and out of engagement with the inner surface 158 of the second tube 138. Continued rotation of the first tube 136 in the second direction causes the abutment wall 214 of the first stopper 170 to engage the second free end 222 of the first collar 168, which then causes the first free end 220 of the first collar 168 to engage the limit wall 212 of the second tube 138 to drivingly rotate the second tube 138.

Once the first collar 168 engages the limit wall 212 of the second tube 138, continued rotation of the first tube 136 in the second direction causes the second tube 138 to rotate correspondingly. Like the discussion above, rotation of the second tube 138 causes the second stopper 240 to rotate within the second collar 246. As the second stopper 240 rotates within the second collar 246, the varying radius of the second stopper 240 causes the second collar 246 to constrict away from and out of engagement with the inner surface 270 of the third tube 140. Continued rotation of the first tube 136 in the second direction may cause the second collar 246 to abut and correspondingly rotate the third tube 140 in a similar manner as discussed above. Like the discussion above, rotation of the third tube 140 in the second direction may release the friction engagement between the third tube 140 and the luggage case 102. In embodiments including more than three tubes, the process may be repeated until all tubes are positioned out of engagement (i.e., the sliding arrangement).

Once the tubes are positioned in the sliding arrangement, the tubes may slide relative one another to adjust the overall length L of the tube structure(s) 134. For example, the first tube 136 may slide relative the second tube 138, the second tube 138 may slide relative the third tube 140, etc. to position the hand grip 132 at a desired height above or away from the luggage case 102. As shown, the tubes may slide relative one another until, for example, the upper rib 178 of each stopper engages the limit stop defined in the next successive tube. Once positioned in a desired position, the hand grip 132 may be rotated to lock the tube structure(s) 134 in position as explained above. In this manner, the tube structure(s) 134 may be infinitely adjustable to position the hand grip 132 at substantially any position above or way from the luggage case 102. In addition, because the tubes within each tube structure 134 are selectively frictionally engaged together, the tubes may be limited or inhibited from wobbling relative one another during operation due to at least the clearance between the tubes being selectively reduced.

Figure 12:
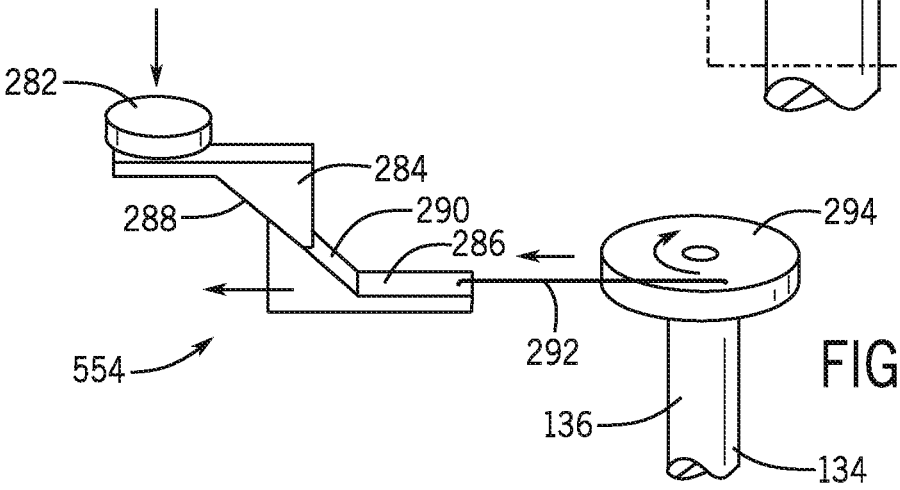
FIG. 12 is a perspective view of an additional locking mechanism in accordance with some examples of the present disclosure.
Figure 13:
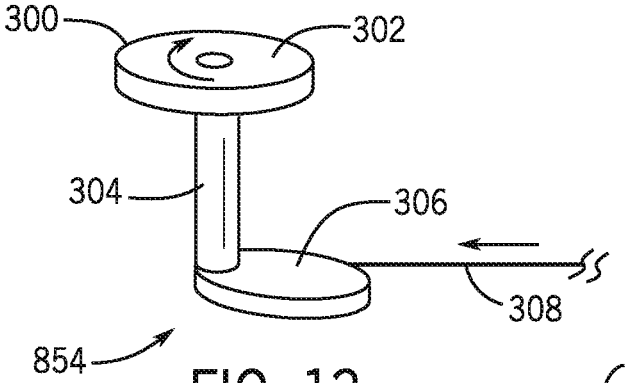
FIG. 13 is a perspective view of an additional locking mechanism in accordance with some examples of the present disclosure.

FIGS. 12 and 13 illustrate additional embodiments of a rotational mechanism 554, 854. With the exception of the description below, the rotational mechanisms 554, 854 of FIGS. 12 and 13 are similar to the rotational mechanism 254 discussed above with reference to FIGS. 11 and 14. Accordingly, in certain instances, descriptions of like features will not be discussed when they would be apparent to those with skill in the art in light of the description above and in view of FIGS. 11-14. For ease of reference, like structure is represented with appropriately incremented reference numbers.

Referring to FIG. 12, at least a portion of the hand grip 432 may be movable, and in this example depressed to cause the rotational mechanism 554 to rotate the first tube 136 relative to the second tube 138. In one non-limiting example, the rotational mechanism 554 may include a push button 282, such as arranged on the hand grip 432. The push button 282 may include a depressible first portion 284 and a second portion 286 arranged to slide relative to the first portion 284 upon actuation of the push button 282 (e.g., upon a user depressing the first portion 284). As shown, each of the first and second portions 284, 286 may include a ramp 288, 290, respectively. When the first portion 284 is pressed by a user, the ramps 288, 290 of the first and second portions 284, 286 cause the second portion 286 to slide away from the tube structure(s) 134. The second portion 286 may be coupled to the first tube 136, such as via a string or monofilament 292 connected to a disc 294 attached to the first tube 136, such that axial movement of the second portion 286 causes the first tube 136 to rotate relative to the second tube 138.

Referring to FIG. 13, the rotational mechanism 854 may include a rotatable button 300. The rotatable button 300 may include a grip portion 302, a shaft 304 extending from the grip portion 302, a cam 306 connected eccentrically to the shaft 304, and an operating cord 308 connected to the cam 306 and to the first tube 136. In such embodiments, rotation of the grip portion 302 may eccentrically rotate the cam 306 to retract or extend the operating cord 308 away from or towards the rotatable button 300. Movement of the operating cord 308 causes the first tube 136 to rotate relative to the second tube 138 similar to the embodiment of FIG. 12 discussed above.

FIGS. 15-22 illustrate additional embodiments of a friction engagement wherein relative movement of the first tube 136 increases the frictional engagement between the first collar 168 and the inner surface 158 of the second tube 138, such as by causing at least a portion of the first collar 168 to outwardly expand to engage the inner surface 158 of the second tube 138. With the exception of the description below, the friction engagement of FIGS. 15-22 are similar to the friction engagement discussed above with reference to FIGS. 7-10. Accordingly, in certain instances, descriptions of like features will not be discussed when they would be apparent to those with skill in the art in light of the description above and in view of the figures. For ease of reference, like structure is represented with appropriately incremented reference numbers.

Figure 15:
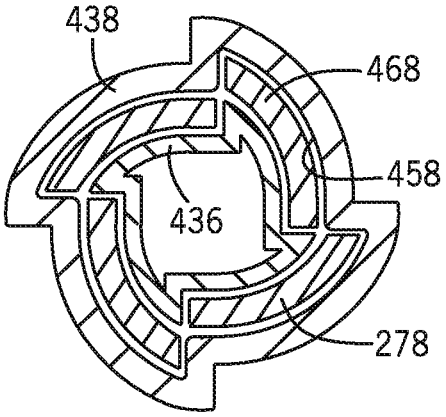
FIG. 15 is a transverse cross-sectional view of an additional tow handle in a sliding arrangement in accordance with some examples of the present disclosure.
Figure 16:
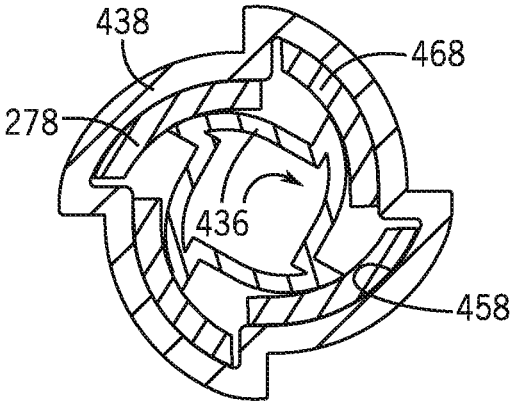
FIG. 16 is a transverse cross-sectional view of the tow handle of FIG. 15 in a locking arrangement in accordance with some examples of the present disclosure.

Referring to FIGS. 15 and 16, the friction engagement may be defined by a multi-snail configuration of the first tube 436, the first collar 468, and the second tube 438. As defined herein, a multi-snail or multiple snail configuration includes a cross-sectional shape having a plurality of snail sections. In such embodiments, the first collar 468 may include a plurality of collar fingers 278 each expandable to engage the inner surface 458 of the second tube 438 at each snail section (see FIG. 16).

Figure 17:
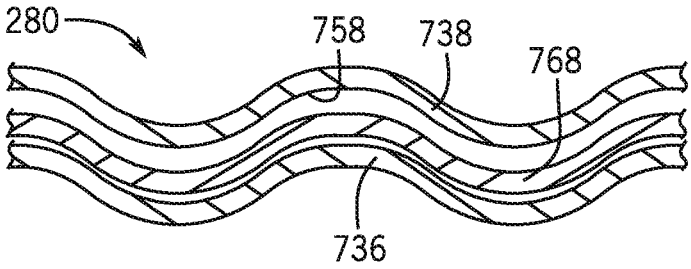
FIG. 17 is a transverse cross-sectional view of an additional tow handle in a sliding arrangement in accordance with some examples of the present disclosure.
Figure 18:
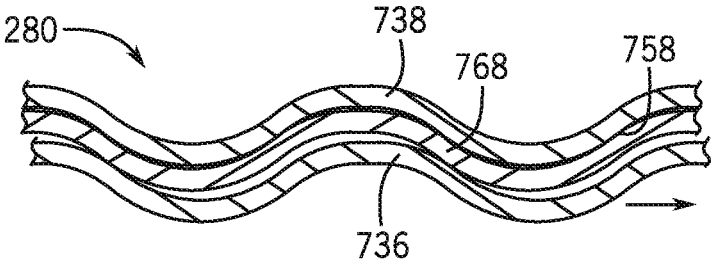
FIG. 18 is a transverse cross-sectional view of the tow handle of FIG. 17 in a locking arrangement in accordance with some examples of the present disclosure.

Referring to FIGS. 17 and 18, the friction engagement may be defined by undulating portions 280 of the first tube 736, the first collar 768, and the second tube 738. In such embodiments, rotation of the first tube 736 causes the first collar 768 to outwardly expand at each undulation 280 to engage the inner surface 758 of the second tube 738 (see FIG. 18).

Figure 19:
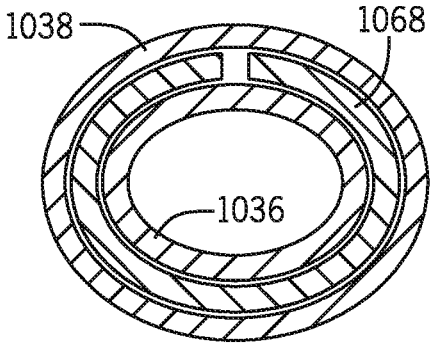
FIG. 19 is a transverse cross-sectional view of an additional tow handle in a sliding arrangement in accordance with some examples of the present disclosure.
Figure 20:
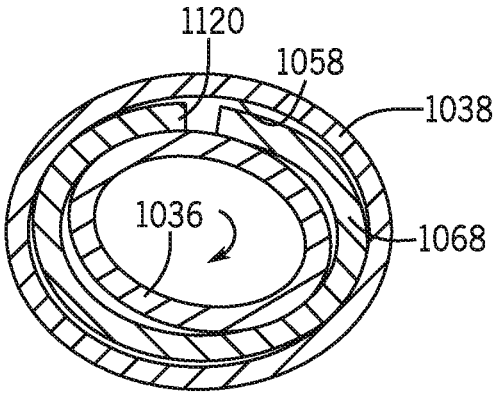
FIG. 20 is a transverse cross-sectional view of the tow handle of FIG. 19 in a locking arrangement in accordance with some examples of the present disclosure.

Referring to FIGS. 19 and 20, the friction engagement may be defined by an oval configuration. As shown, each of the first tube 1036, the first collar 1068, and the second tube 1038 includes an oval cross-section. In such embodiments, rotation of the first tube 1036 causes the first collar 1068 (e.g., at least the first free end 1120 of the first collar 1068) to expand outwardly to engage the inner surface 1058 of the second tube 1038 (see FIG. 20).

Figure 21:
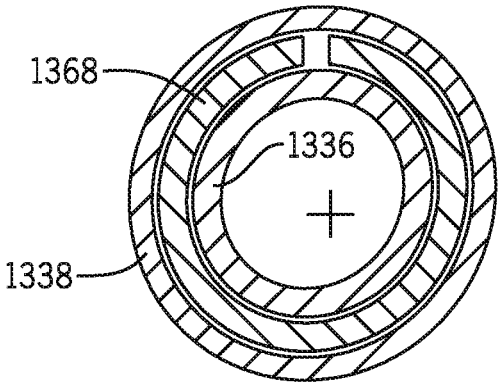
FIG. 21 is a transverse cross-sectional view of an additional tow handle in a sliding arrangement in accordance with some examples of the present disclosure.
Figure 22:
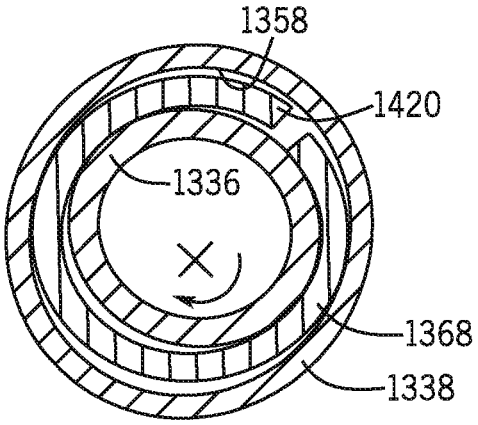
FIG. 22 is a transverse cross-sectional view of the tow handle of FIG. 21 in a locking arrangement in accordance with some examples of the present disclosure.

With reference to FIGS. 21 and 22, the friction engagement may be defined by the first tube 1336 rotating eccentrically within the second tube 1338. In such embodiments, eccentric rotation of the first tube 1336 causes a portion of the first collar 1368 (e.g., at least the first free end 1420 of the first collar 1368) to expand outwardly to engage the inner surface 1358 of the second tube 1338 in a similar manner as described above (see FIG. 22).

Though the embodiments of FIGS. 15-22 include a collar positioned between the tubes, as noted above, the outer surface 154 of the first tube 136 may be arranged to engage the inner surface 158 of the second tube 138 directly, such as frictionally, meshingly, interferingly, or the like. In such embodiments, the varying radius of the first tube 136 may be arranged to reduce the clearance between the first and second tubes 136, 138 upon rotation of the first tube 136 relative the second tube 138 to cause the friction engagement therebetween.

The tow handle 130 may be formed from a variety of materials and means. For example, the first stopper 170, the first collar 168, and the hand grip 132 may be formed from a thermoplastic material (self-reinforced or fiber reinforced), ABS, polycarbonate, polypropylene, polystyrene, PVC, polyamide, and/or PTFE, among others. Similarly, the first and second tubes 136, 138 may be extruded from aluminum or other similar metal. In addition, the first and second tubes 136, 138 may be formed from fiber reinforced epoxy, resin, or other similar material. The tow handle 130 may be formed or molded in any suitable manner, such as by plug molding, blow molding, injection molding, extrusion, casting, or the like.

The luggage case 102 may be substantially any type of luggage article (e.g., bag, case, rollable backpack, etc.), though in preferred embodiment the luggage case 102 is an upright spinner case. In such embodiments, the luggage case 102 includes other features for convenience, such as a base 350, a lid 352 pivotably coupled to the base 350, and at least one carry handle 354 (see FIG. 1). The luggage case 102 may be moldable hardside material, softside material, or a combination of hardside material and softside material. The softside material may be nylon, canvas, polyester, leather, PVC, polypropylene, polyethylene, and/or PTFE, among others. The hardside material may be a thermoplastic material (self-reinforced or fiber reinforced), ABS, polycarbonate, polypropylene, polystyrene, PVC, polyamide, and/or PTFE, among others. Like the tow handle 130, the luggage case 102 may be formed or molded in any suitable manner, such as by plug molding, blow molding, injection molding, or the like.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

The invention claimed is:

1. An extendable tow handle for a luggage article, the tow handle attached to the luggage article, the tow handle comprising:

at least one tube structure each including first and second tubes, the first and second tubes slidably received within and selectively rotatable relative one another;

a rotational mechanism operable to rotate the first tube relative to the second tube or the second tube relative to the first tube; and a hand grip coupled to one of the first and second tubes for gripping the tow handle by a user;

wherein the first and second tubes are arranged such that rotation of the first tube relative to the second tube or the second tube relative to the first tube causes at least a portion of the first tube to couple with a portion of the second tube to selectively frictionally lock axial movement of the first tube relative to the second tube; and wherein rotation of at least a portion of the hand grip causes the rotational mechanism to position the at least one tube structure in either the sliding or locking arrangement.

2. The tow handle of claim 1, wherein the first and second tubes couple along a substantial portion of the length of each tube structure.

3. The tow handle of claim 1, further comprising:

a collar rotatably coupled to one of the first and second tubes and selectively coupleable with the other of the first and second tubes to create the selective friction coupling between the first and second tubes; and a mechanism for axially locating the collar along a portion of either the first or second tube.

4. The tow handle of claim 3, wherein the selective friction coupling between the first and second tubes comprises:

a first friction interface between the collar and one of the first and second tubes, the first friction interface including a first coefficient of friction; and a second friction interface between the collar and the other of the first and second tubes, the second friction interface including a second coefficient of friction greater than the first coefficient of friction.

5. The tow handle of claim 4, wherein:

the first friction interface is between the collar and the first tube; and the second friction interface is between the collar and the second tube.

6. The tow handle of claim 3, wherein the mechanism for axially locating the collar includes a stopper associated with a portion of the first or second tube, the stopper defining an annular recess therein for receiving at least a portion of the collar such that the collar slides correspondingly with the stopper.

7. The tow handle of claim 6, wherein the stopper is defined adjacent an end of either the first or second tube.

8. The tow handle of claim 6, wherein:

the first tube or the stopper includes an outer surface of varying radius such that rotation of at least a portion of the first tube or the stopper relative to the collar increases engagement between the collar and an inner surface of the second tube; and the inner surface of the second tube includes a varying radius corresponding to the outer surface of the collar.

9. The tow handle of claim 3, wherein:

the collar includes an inner surface arranged to engage an outer surface of either the first tube or the stopper; and the collar includes an outer surface arranged to engage an inner surface of the second tube.

10. The tow handle of claim 9, wherein:

the inner surface of the collar is parallel to the outer surface of the stopper or the first tube; and the outer surface of the collar is parallel to the inner surface of the second tube.

11. The tow handle of claim 9, wherein the outer surface of the stopper or the first tube is parallel to the inner surface of the second tube.

12. The tow handle of claim 1, wherein:

the rotational mechanism moves the at least one tube structure between a sliding arrangement wherein the first and second tubes of the at least one tube structure are permitted to slide relative each other, and a locking arrangement wherein sliding movement of the first and second tubes relative each other is limited.

13. The tow handle of claim 12, wherein the hand grip is at and rotates about an axis oriented at an angle to the at least one tube structure.

14. The tow handle of claim 1, further comprising a biasing assembly operable to bias the at least one tube structure to frictionally lock axial movement of the first tube relative to the second tube.

15. The tow handle of claim 14, wherein the biasing assembly includes a torsion spring biasing rotation of the hand grip to frictionally lock the at least one tube structure.

16. The tow handle of claim 1, wherein the first tube is slidably received within the second tube and selectively rotatable thereto; the rotational mechanism operable to rotate the first tube relative to the second tube; and the first and second tube being arranged such that rotation of the first tube relative to the second tube causes the at least a portion of the first tube to couple with a portion of the second tube to selectively frictionally lock axial movement of the first tube relative to the second tube.

* * * * *